US008591352B2

(12) United States Patent
Hirano

(10) Patent No.: US 8,591,352 B2
(45) Date of Patent: Nov. 26, 2013

(54) GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 164 days.

(21) Appl. No.: 12/973,324

(22) Filed: Dec. 20, 2010

(65) Prior Publication Data

US 2011/0152001 A1 Jun. 23, 2011

(30) Foreign Application Priority Data

Dec. 21, 2009 (JP) ..... 2009-289440

(51) Int. Cl.
*A63B 53/06* (2006.01)

(52) U.S. Cl.
USPC ..... 473/336; 473/337; 473/338; 473/345

(58) Field of Classification Search
USPC ..... 473/334–339, 345–346
See application file for complete search history.

(56) References Cited

U.S. PATENT DOCUMENTS

| | | | | |
|---|---|---|---|---|
| 3,897,066 | A * | 7/1975 | Belmont | 473/337 |
| 3,979,122 | A * | 9/1976 | Belmont | 473/336 |
| 4,411,430 | A * | 10/1983 | Dian | 473/337 |
| 4,811,950 | A * | 3/1989 | Kobayashi | 473/335 |
| 4,828,266 | A * | 5/1989 | Tunstall | 473/336 |
| 5,013,041 | A * | 5/1991 | Sun et al. | 473/252 |
| 5,571,053 | A * | 11/1996 | Lane | 473/336 |
| 6,348,014 | B1 * | 2/2002 | Chiu | 473/337 |
| 7,559,854 | B2 * | 7/2009 | Harvell et al. | 473/334 |
| 7,824,277 | B2 * | 11/2010 | Bennett et al. | 473/328 |
| 7,862,451 | B2 * | 1/2011 | Harvell et al. | 473/334 |
| 7,997,998 | B2 * | 8/2011 | Bennett et al. | 473/328 |
| 2002/0032075 | A1 * | 3/2002 | Vatsvog | 473/334 |
| 2002/0137576 | A1 * | 9/2002 | Dammen | 473/336 |
| 2005/0096151 | A1 * | 5/2005 | Hou et al. | 473/335 |
| 2005/0277485 | A1 * | 12/2005 | Hou et al. | 473/332 |
| 2007/0135231 | A1 * | 6/2007 | Lo | 473/336 |
| 2007/0149315 | A1 * | 6/2007 | Bennett et al. | 473/334 |
| 2007/0243943 | A1 * | 10/2007 | Inouye et al. | 473/249 |
| 2008/0119303 | A1 * | 5/2008 | Bennett et al. | 473/338 |
| 2008/0139333 | A1 * | 6/2008 | Klein | 473/251 |
| 2010/0304887 | A1 * | 12/2010 | Bennett et al. | 473/336 |
| 2011/0230278 | A1 * | 9/2011 | Bennett et al. | 473/335 |
| 2011/0275453 | A1 * | 11/2011 | Tavares et al. | 473/334 |

FOREIGN PATENT DOCUMENTS

JP 2004-159680 A 6/2004

* cited by examiner

*Primary Examiner* — Stephen L. Blau
(74) *Attorney, Agent, or Firm* — Birch, Stewart, Kolasch & Birch, LLP

(57) ABSTRACT

A golf club head comprises: a hollow structure having an insertion-opening in the outer surface of the golf club head; a quick-release lid of the insertion-opening; a tubular part disposed in a hollow of the hollow structure and having a bottomed hole with which the insertion-opening communicates; and a gravity point adjuster. The gravity point adjuster comprises: a heavy-weight member having a specific gravity and a length L2; a light-weight member having a specific gravity less than that of the heavy-weight member and a length L1 more than the length L2; and an elastic member having a specific gravity less than that of the heavy-weight member, and an elastic modulus lower than those of the heavy-weight member and light-weight member. The heavy-weight member, light-weight member and elastic member are inserted in the bottomed hole by the use of the insertion-opening so that their relative positions relative to the bottomed hole can be changed easily by the golfer himself or herself.

22 Claims, 10 Drawing Sheets

GOLF CLUB HEAD

BACKGROUND OF THE INVENTION

The present invention relates to a golf club head capable of changing the position of the center of gravity of the golf club head.

Performance of a golf club head can be changed by changing the position of the center of gravity of the golf club head. For example, if the center of gravity of a golf club head measured from the sweet spot of the club face is shallow, it is easy for the golfer to control the direction of the club head, therefore, it is also easy to control the direction of the ball. On the other hand, in the case that the center of gravity is deep, even if the golfer makes a missed shot, the direction of the club head is hard to change, therefore, the directionality of the hit ball becomes stable.

Therefore, a golf club head of which center of gravity is adjustable has been proposed for example in the Japanese Patent Application Publication No. 2004-159680.
The golf club head disclosed in this Publication is provided with one or more holes, at least one of which contains a metallic weight member and cushion material such as cork and resin foam. By changing the position of the weight member in the hole, naturally, the position of the center of gravity of the head can be changed. But, the disclosed golf club head is not constructed such that it is possible to change the position of the center of gravity of the head by the golfer himself or herself according to the golfer's physical conditions, golf course layouts and the like.

SUMMARY OF THE INVENTION

It is therefore, an object of the present invention to provide a golf club head, in which the position of the center of gravity can be changed largely and easily in a short time by the golfer himself or herself according to the golfer's physical conditions, golf course layouts and the like.

According to the present invention, a golf club head comprises: a hollow structure having an insertion-opening in the outer surface of the golf club head; a quick-release lid of the insertion-opening; a tubular part disposed in a hollow of the hollow structure and having a bottomed hole with which the insertion-opening communicates; and a gravity point adjuster, the gravity point adjuster comprising a heavy-weight member having a specific gravity and a length L2, a light-weight member having a specific gravity less than that of the heavy-weight member and a length L1 more than the length L2, and an elastic member having a specific gravity less than that of the heavy-weight member, and an elastic modulus lower than those of the heavy-weight member and the light-weight member, wherein the heavy-weight member, the light-weight member and the elastic member are inserted in the bottomed hole by the use of the insertion-opening so that their relative positions relative to the bottomed hole can be changed.

In this application including the description and claims, sizes, positions, directions and the like relating to the golf club head refer to those under a standard state of the golf club head unless otherwise noted.

The standard state of the golf club head is such that the head is placed on a horizontal plane HP so that the central axis of the clubshaft (not shown) is inclined at the lie angle alpha while keeping the central axis of the clubshaft on a vertical plane VP, and the club face forms its loft angle beta with respect to the horizontal plane HP. Incidentally, in the case of the golf club head alone, the center line of the shaft inserting hole 7*a* can be used instead of the central axis of the clubshaft.

The depth of the center of gravity G of the golf club head is, as shown in FIG. 10, defined as the distance GL measured in the horizontal direction between the center of gravity G and the leading edge of the golf club head in the standard state.

The leading edge is a contact point between the club face 2 and a vertical plane VP1 parallel with the vertical plane VP.

The front-back direction is a direction parallel with a straight line N projected on the horizontal plane HP, wherein the straight line N is a line drawn normally to the club face 2 passing through the center of gravity G.

The toe-heel direction is a direction parallel with the horizontal plane HP and perpendicular to the front-back direction.

DESCRIPTION OF THE PREFERRED EMBODIMENTS

Figure 1:
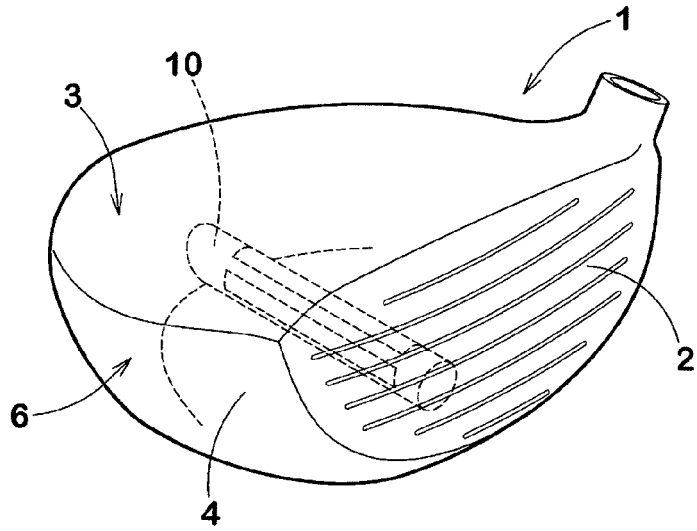
FIGS. 1, 2, 3 and 4 are perspective views each showing a golf club head according to the present invention.

Taking a wood-type golf club head as an example, embodiments of the present invention will now be described in detail in conjunction with accompanying drawings.

In the drawings, golf club head 1 according to the present invention is a hollow head for a wood-type golf club such as driver (#1) or fairway wood, and
the golf club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*.
Thus, the golf club head 1 is provided with a hollow (i) and a shell structure with the thin wall.

In order to increase a moment of inertia of the golf club head 1, and improve swing balance and the directionality of the hit balls, the volume of the golf club head 1 is preferably set in a range of not less than 380 cc, more preferably not less than 400 cc, but not more than 460 cc, more preferably not more than 450 cc. And the mass of the club head is preferably set in a range of not less than 175 g, more preferably not less than 180 g, but not more than 220 g, more preferably not more than 215 g.

The golf club head 1 can be formed by assembling two or more parts which are manufactured through suitable processes such as forging, casting, press working and the like, and fixing the parts each other by suitable means, for example, welding, soldering, adhesive, press fitting and the like.

The golf club head 1 according to the present invention is provided with at least one tubular part 10 for accommodating a gravity point adjuster 14.

In the case of the wood-type golf club head, the tubular part(s) 10 is(are) formed within the shell structure as shown in FIGS. 1-5.

The shell structure can be made of one or more kinds of metal materials. For example, aluminum alloys, titanium alloys, stainless steels and the like can be used.

Figure 9:
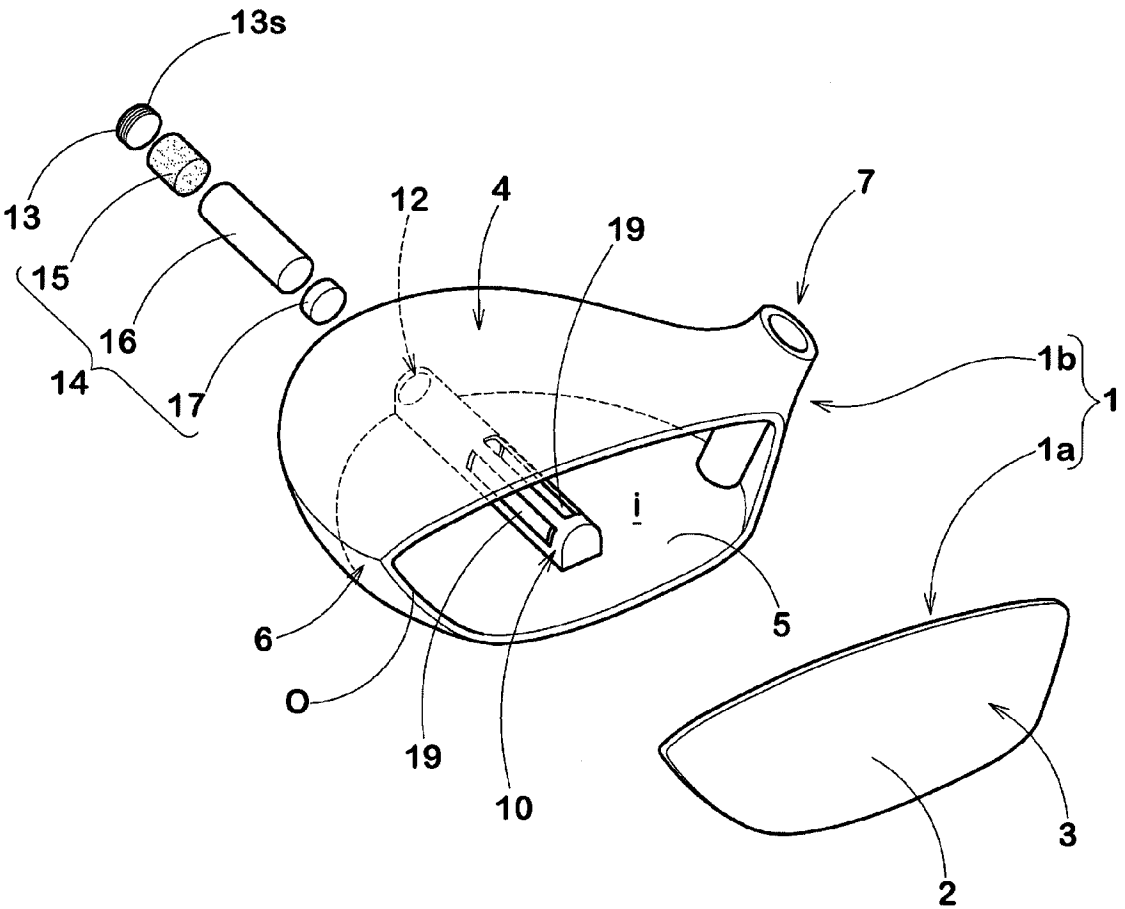
FIG. 9 is an exploded perspective view showing a hollow structure common to the golf club heads shown in FIGS. 1-4 together with the tubular part of the golf club head shown in FIG. 1.

An example of the shell structure is shown in FIG. 9, which comprises: a main body 1*b* provided with a front opening O and formed through lost-wax precision casting process; and a face plate 1*a* made of a rolled titanium alloy and welded to the main body 1*b* so that the face plate 1*a* closes the front opening O and forms a major part of the face portion 3.

FIG. 1 shows an embodiment provided with one horizontal tubular part 10 extending in the front-back direction of the club head.

Figure 2:
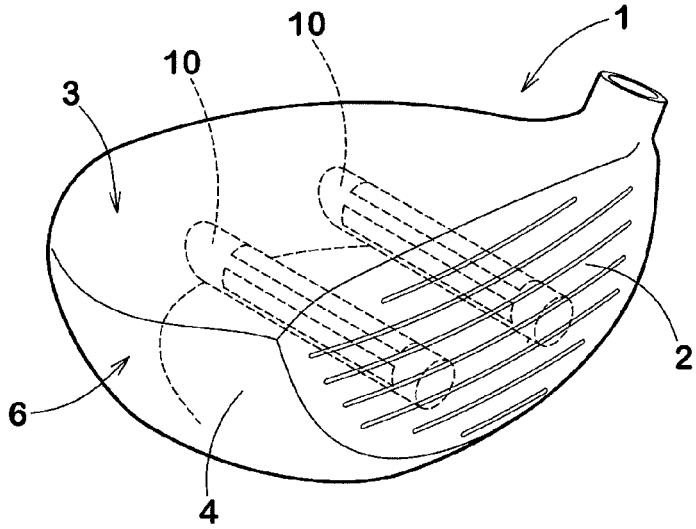

FIG. 2 shows another embodiment provided with two horizontal tubular parts 10 arranged side-by-side in the toe-heel direction.

Figure 3:
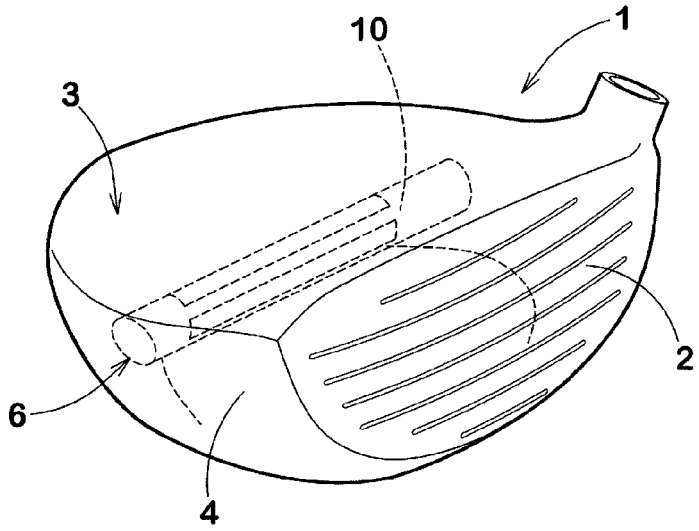

FIG. 3 shows still another embodiment provided with one horizontal tubular part 10 extending in the toe-heel direction.

Figure 4:
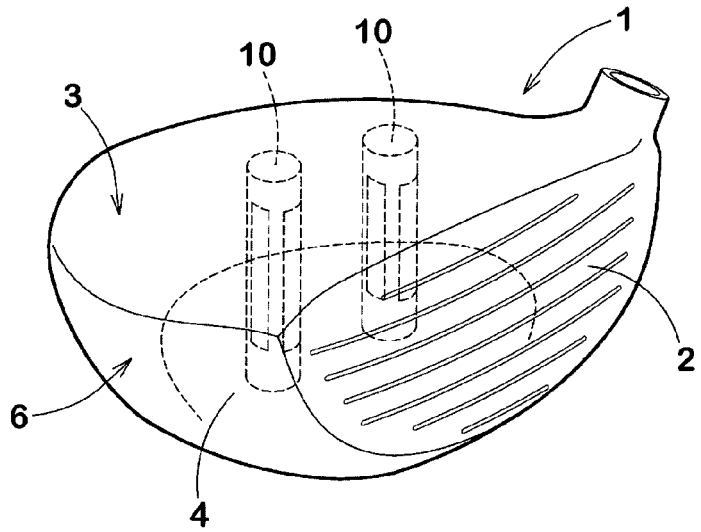
Figure 5:
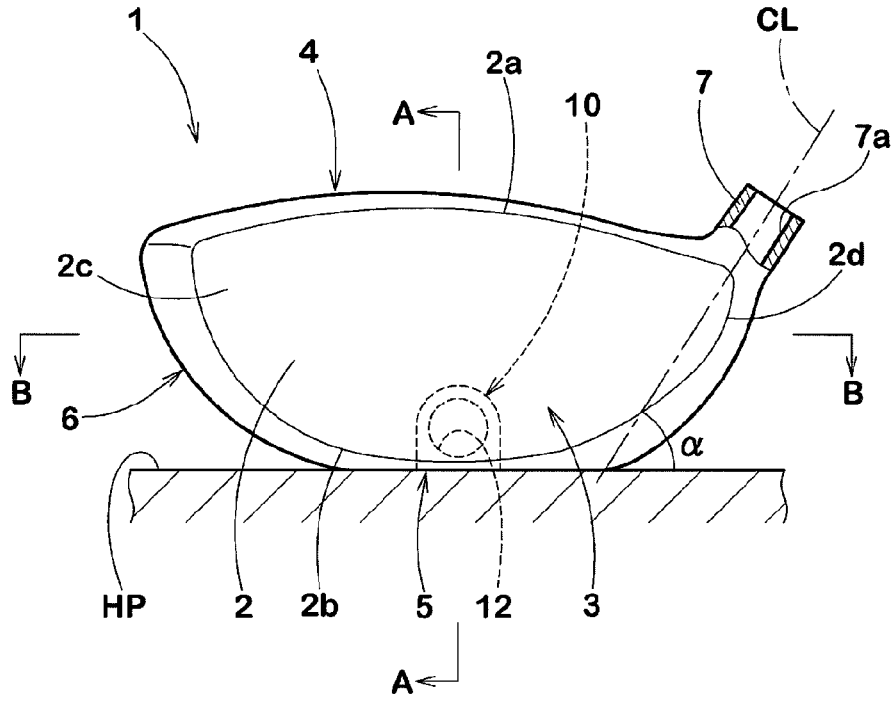
FIG. 5 is a front view of the golf club head shown in FIG. 1.

FIG. 4 shows still more another embodiment provided with two vertical tubular parts 10 arranged side-by-side in the toe-heel direction.

In either embodiment, the golf club head 1 is provided with at least one set of: the tubular part 10 having a bottomed hole 11; an insertion-opening 12 opened in the outer surface 1A of the club head to communicate with the inside of the bottomed hole 11; and a quick-release lid 13 closing the insertion-opening 12.

The bottomed hole 11 in this example is a space in the form a circular cylinder. The bottomed hole 11 has a smooth inner peripheral surface, excepting an end part on the insertion-opening 12 side which is threaded. This threaded part (internal thread) 11*n* ranges from the insertion-opening 12 to a distance Li therefrom towards the bottomed end of the bottomed hole 11 along the central axis of the bottomed hole 11. The cross-sectional shape of the bottomed hole 11 is a circle and diameter is constant all over the length (or depth).

The quick-release lid 13 in this example is a disk of which outer peripheral surface is provided with an external thread 13*s* which can engage with the internal thread 11*n* of the bottomed hole 11.

Figure 6:
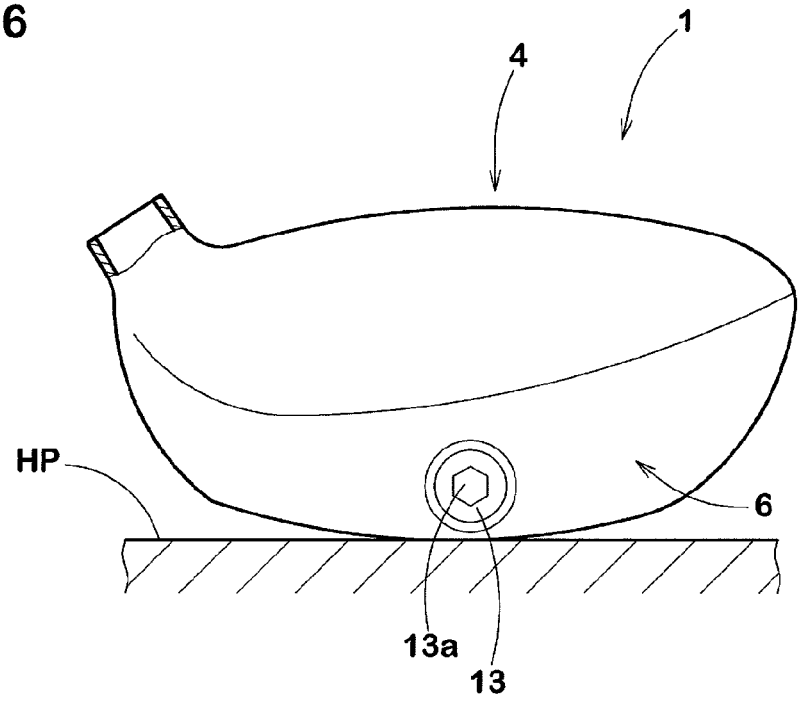
FIG. 6 is a rear view thereof.
Figure 7:
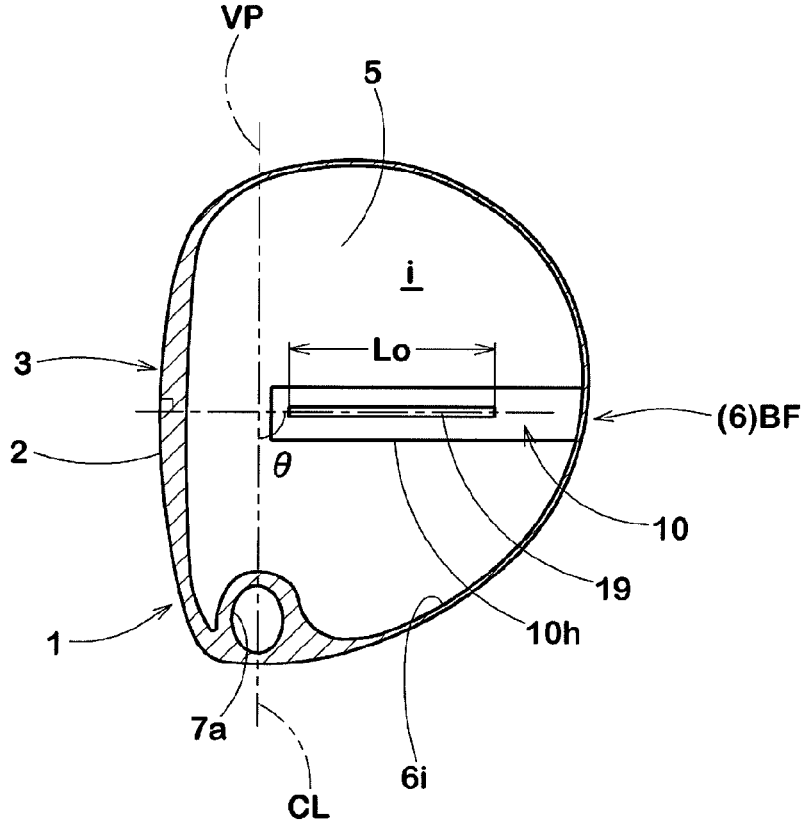
FIG. 7 is a horizontal cross sectional view taken along line B-B in FIG. 5.

In order to turn the lid 13, the outer surface of the lid 13 is provided with a socket 13*a*, slot or the like to engage with the end of a screw wrench, a specialized tool, a coin or the like. In the case of the example shown in FIG. 6, a hexagon socket 13*a* is formed to engage with a hex wrench. But in view of convenience, a combination of a coin and a slot is preferred. When the lid 13 is attached to the golf club head, the lid 13 becomes flush with the outer surface of the golf club head or slightly sunk from the outer surface.

In order to secure the necessary strength for the lid 13, the specific gravity ρc of the lid 13 is preferably not less than 4.0, more preferably not less than 4.4, but not more than 8.5, more preferably not more than 8.1, and the mass We of the lid 13 is preferably not less than 1.5 g, but not more than 3.5 g.

As to the method for fixing the lid 13 to the insertion-opening 12, aside form the engaging of the threads, various methods utilizing spring, bolt or the like may be employed as far as it is possible to attach or detach easily.

In the first, second and third embodiments shown in FIG. 1, FIG. 2 and FIG. 3, respectively, the tubular part 10 is formed on the inside of the sole portion 5 integrally with the sole portion 5 by means of casting for example.

In the first and second embodiments shown in FIG. 1 and FIG. 2, respectively, the tubular part 10 is extended parallel with the front-back direction of the golf club head 1 from the back side of the golf club head towards the face portion, and terminated without reaching to the rear face of the face portion 3. The front end of the tubular part 10 is closed within the hollow (i). The rear end of the tubular part 10 is integrally connected to the inside of the side portion 6 so that the opening aligns with the insertion-opening 12 opened in the outer surface 1A on the back side.

Therefore, the golf club head 1 has the bottomed hole 11 extending from the insertion-opening 12 at the back side of the golf club head toward the face portion. For example, in the plan view of the golf club head under its standard state, the central axis of the bottomed hole 11 is substantially perpendicular to the club face 2, namely, the angle θ between the central axis and the above-mentioned vertical plane VP is 90+/−10 degrees.

In the third embodiment shown in FIG. 3, the tubular part 10 is extended parallel with the toe-heel direction of the golf club head 1 from the heel-side of the golf club head toward the toe, and terminated without reaching to the toe-side of the side portion 6. The toe-side end of the tubular part 10 is closed within the hollow (i). The heel-side end of the tubular part 10 is integrally connected to the inside of the side portion 6 so that the opening aligns with the insertion-opening 12 opened in the outer surface 1A on the heel-side.

Therefore, the golf club head 1 has the bottomed hole 11 extending from the insertion-opening 12 at the heel side of the golf club head toward the heel.

In this embodiment, it is possible to shift the position of the center of gravity toward the heel or toe. As a result, it becomes possible to control open and close states of the club face 2 at impact, therefore, it is possible to make a slice or hook shot intentionally.

In the fourth embodiment shown in FIG. 4, the tubular part 10 is extended from the sole portion 5 toward the crown portion 4. The upper end of the tubular part 10 is closed within the hollow (i). The lower end of the tubular part 10 is integrally connected to the inside of the sole portion so that the opening aligns with the insertion-opening 12 opened in the outer surface 1A of the sole portion.

Therefore, the golf club head 1 has the bottomed hole 11 extending from the insertion-opening 12 in the sole portion toward the crown portion. In this embodiment, it is possible to shift the position of the center of gravity toward the crown or sole. As a result, it becomes possible to control the ballistic course (high or low) of the ball.

In the above-mentioned embodiments, the tubular part 10 is formed integrally with the main body 1*b*. However, it is also possible that the tubular part 10 is formed separately from the main body 1*b*, and then mounted on the sole portion 5 fixedly by means of welding, bolt or the like. In this case, it is preferred that the tubular part 10 is made of a material whose specific gravity is smaller than the sole portion 5.

And in order to secure the strength and to prevent the mass of the club head 1 from increasing, preferably the specific gravity pt of the tubular part 10 is set to be not less than 0.9, more preferably not less than 1.15, but not more than 3.0, more preferably not more than 2.8.

In order to widen the adjustable range of the position of the center of gravity, the effective length L of the bottomed hole 11 is set to be not less than 55 mm, preferably not less than 60 mm, but not more than 100 mm, preferably not more than 90 mm.

Here, the effective length L is that of the space which can accommodate the gravity point adjuster 14. More specifically, the effective length L is a length measured along the central axis of the bottomed hole 11 from the bottom end lib of the bottomed hole 11 to the threaded part 11*n*, namely, to the lid 13 (in this example, to the lid screwed mostly into the hole).

In order to reduce the mass of the tubular part 10, the wall 10*h* of the tubular part 10 is preferably provided with one or more through-holes 19 reaching to the hollow (i).

The through-hole 19 in this example is an elongate hole extending in the direction of the central axis of the bottomed hole 11, and the length Lo thereof is not less than 0.30 times, preferably not less than 0.38 times, but not more than 0.75 times, preferably not more than 0.67 times the effective length L of the bottomed hole 11.

The length L4 of the lid 13 measured in the direction of the central axis of the bottomed hole 11 is preferably not less than 4 mm, more preferably not less than 4.7 mm, but not more than 10 mm, more preferably not more than 9.3 mm.

The depth Li of the internal thread 11*n* is substantially equal to or slightly smaller than the length L4. Thus, the depth Li is not less than 4 mm, preferably not less than 4.7 mm, but not more than 10 mm, preferably not more than 9.3 mm.

In the case of the golf club head provided with a plurality of horizontal tubular parts 10 as shown in FIGS. 2 and 4, at least one tubular part 10 contains a gravity point adjuster 14, which means it is possible that at least one of the plural tubular parts 10 is empty.

However, by inserting the gravity point adjuster 14 in each of the tubular parts 10, the number of the undermentioned members 15-17 is multiplied, and the arrangement patterns of the members 15-17 are increased, and as a result, the adjustable range of the position of the center of gravity can be widened.

The gravity point adjuster 14 according to the present invention is a set of a heavy-weight member 15, a light-weight member 16 and an elastic member 17.

Figure 8:
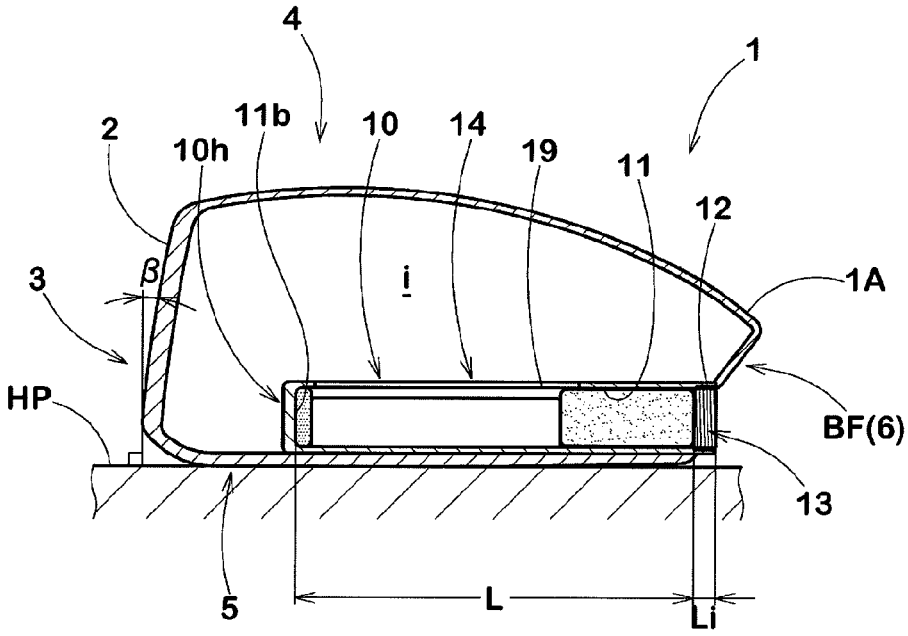
FIG. 8 is a vertical cross sectional view taken along line A-A in FIG. 5.
Figure 10:
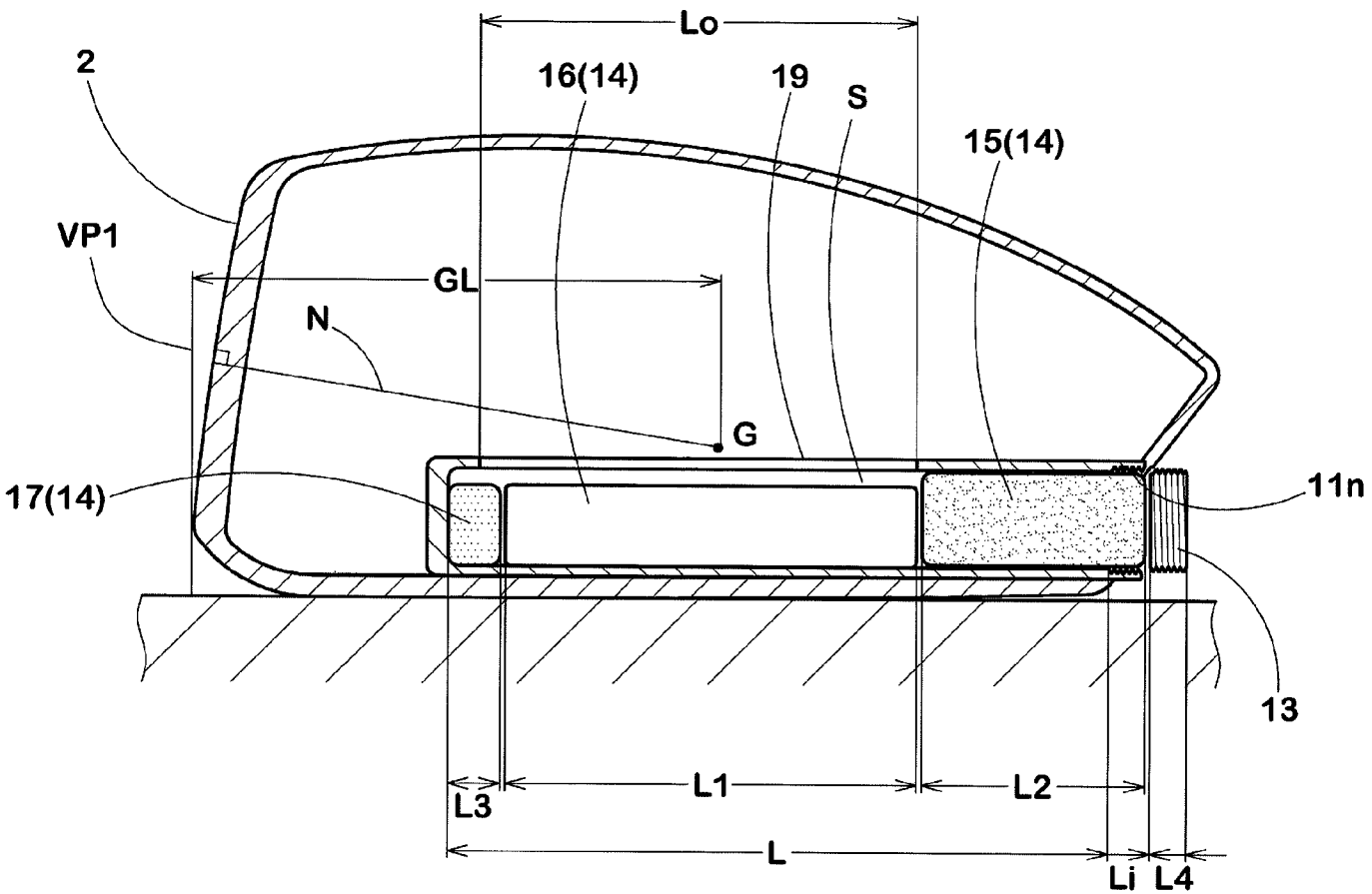
FIG. 10 is a side view of a separate-type gravity point adjuster inserted in a bottomed hole of the golf club head to show a free state of the gravity point adjuster.

FIGS. 8, 9 and 10 show first examples of the heavy-weight member 15, light-weight member 16 and elastic member 17.

Figure 13:
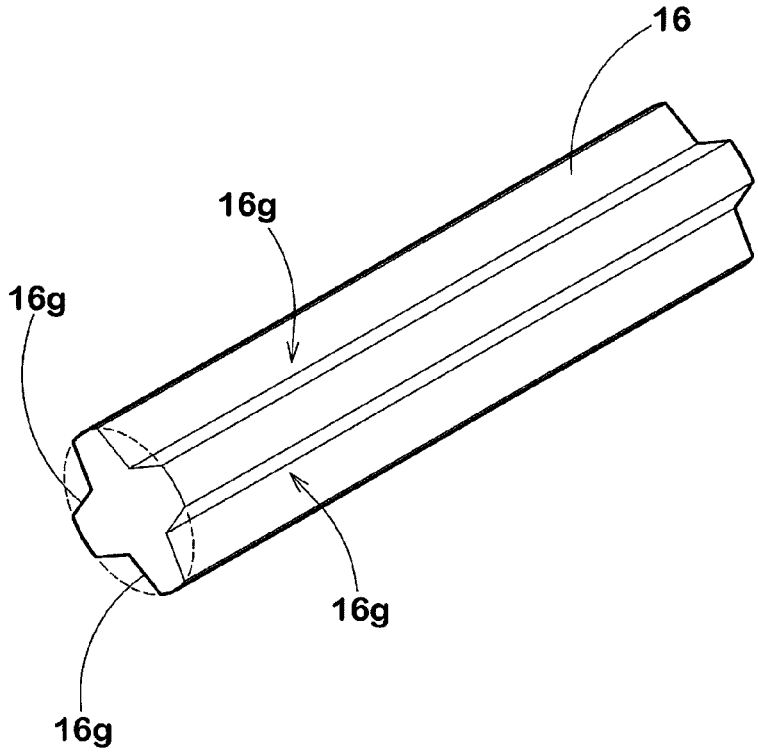
FIGS. 13 and 14 are perspective views each showing another example of the light-weight member.

FIG. 13 shows another example of the light-weight member 16.

Figure 14:
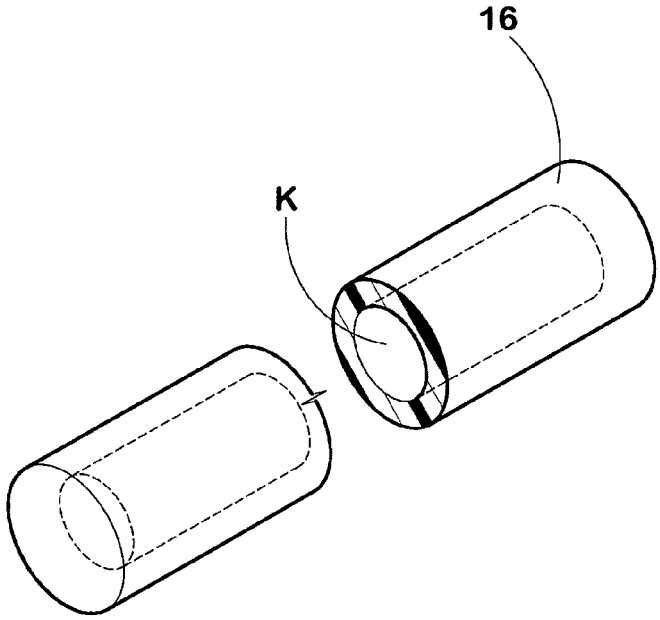

FIG. 14 shows still another example of the light-weight member 16.

Figure 15:
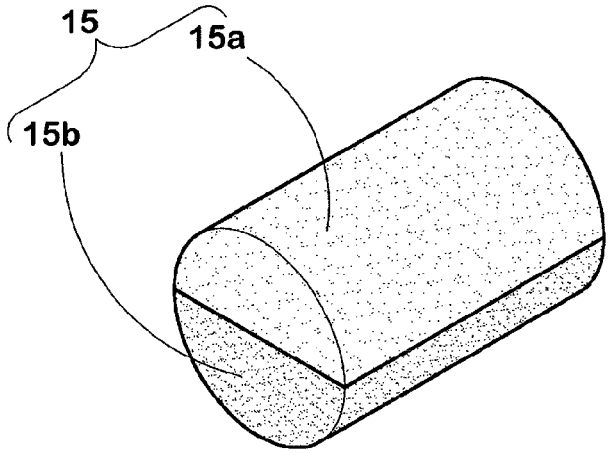
FIG. 15 is a perspective view of another example of the heavy-weight member.

FIG. 15 shows another example of the heavy-weight member 15.

Figure 16:
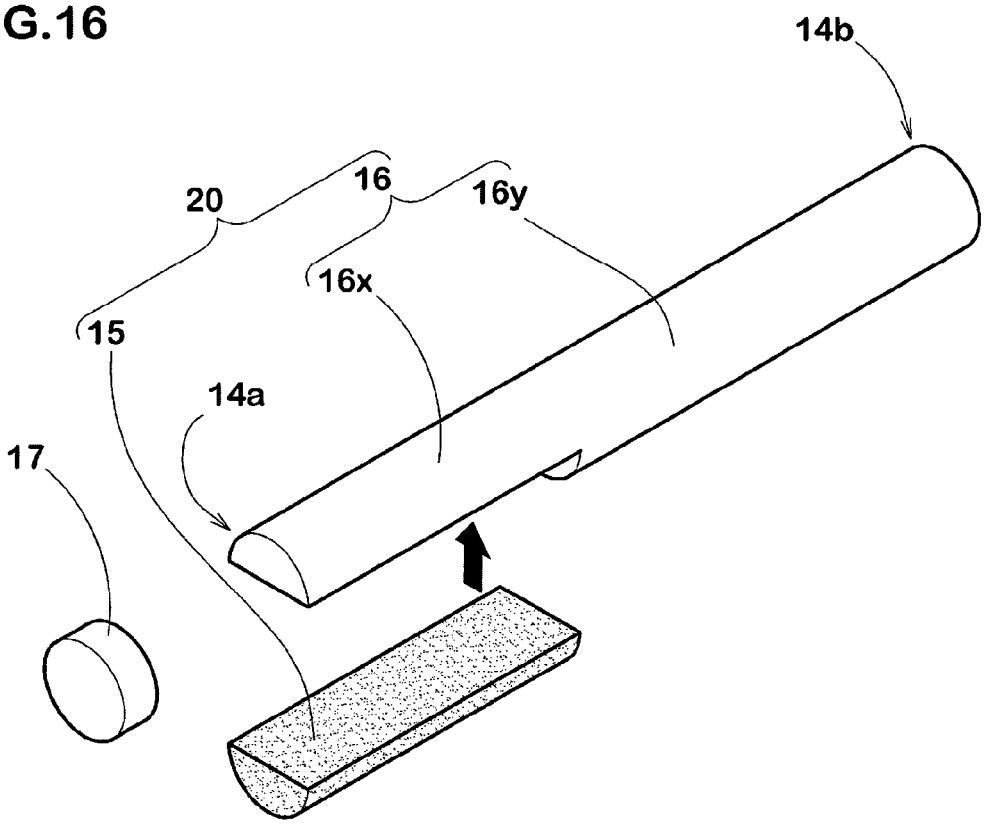
FIGS. 16, 17 and 18 are perspective views each showing a combination of another example of the heavy-weight member and another example of the light-weight member which are combined.

FIG. 16 shows the combined heavy-weight member 15 and light-weight member 16.

Figure 17:
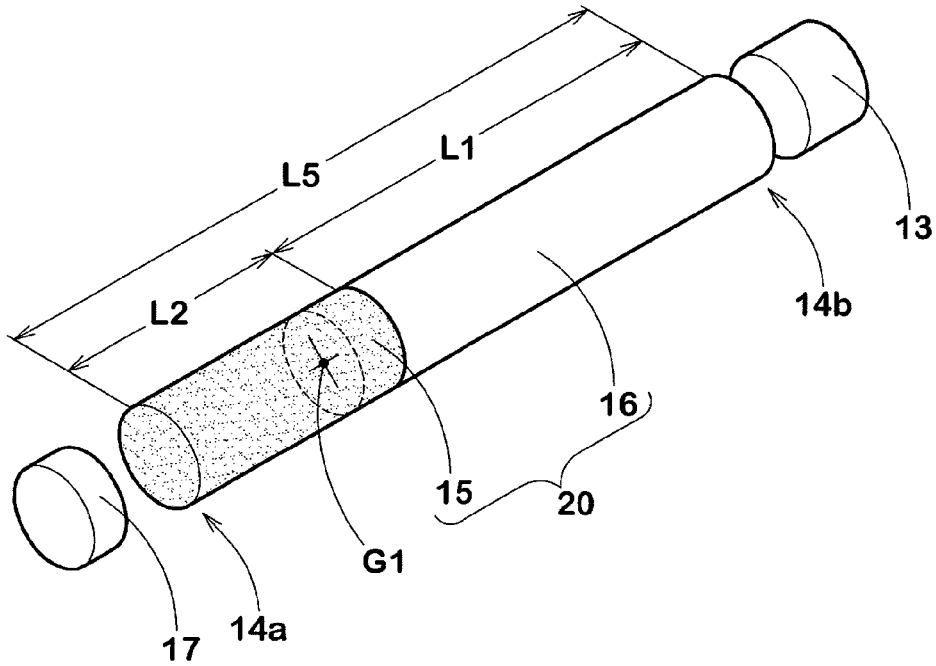

FIG. 17 shows another example of the combined heavy-weight member 15 and light-weight member 16.

Figure 18:
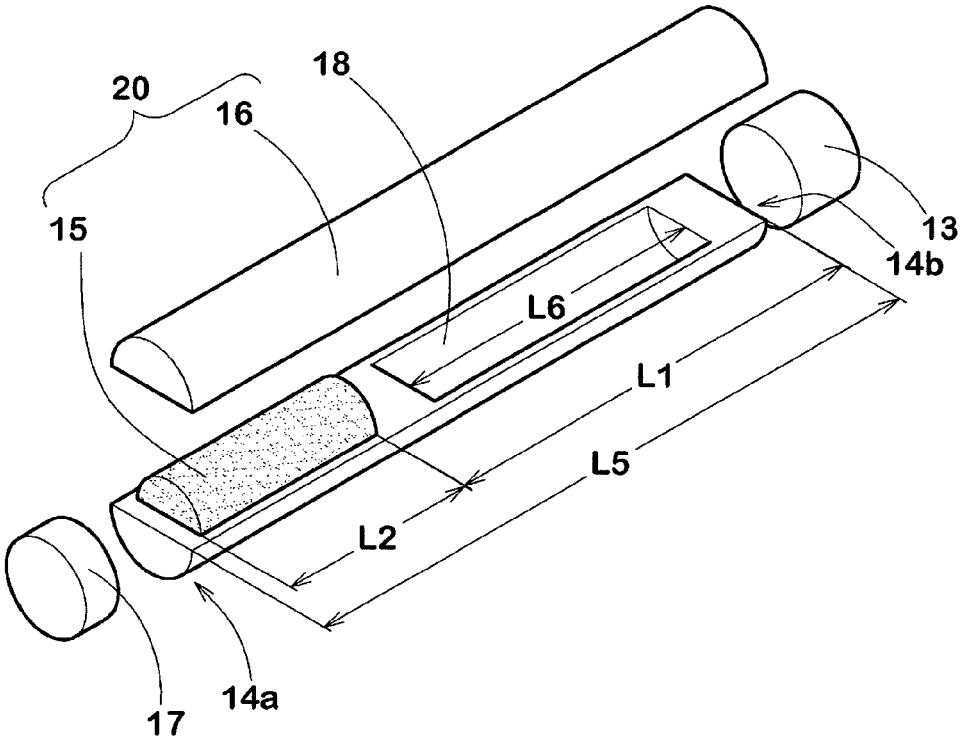

FIG. 18 shows still another example of the combined heavy-weight member 15 and light-weight member 16.

The heavy-weight member 15 has a specific gravity ρo and a largest mass Wo in the gravity point adjuster 14.

The specific gravity ρo is preferably not less than 6.0, more preferably not less than 7.0, but not more than 18.0, more preferably not more than 16.0. If the specific gravity ρo is less than 6.0, it is difficult to shift the center of gravity widely. If the specific gravity ρo is more than 18.0, there is a possibility that the mass of the club head 1 increases and the swing balance is deteriorated.

The mass Wo is preferably not less than 8.0 g, more preferably not less than 9.5 g, but not more than 20.0 g, more preferably not more than 18.0 g. If the mass Wo is less than 8.0 g, it is difficult to shift the center of gravity widely. If the mass Wo is more than 20.0 g, there is a possibility that the mass of the club head 1 increases and the swing balance is deteriorated.

For the heavy-weight member 15, stainless steel, tungsten, tungsten alloy, copper alloy, nickel alloy and the like may be suitably used alone or in combination.

The light-weight member 16 has a specific gravity ρk smaller than that of the heavy-weight member 15.

The specific gravity ρk is preferably not less than 0.9, but not more than 1.7 in order to provide strength and rigidity.

The mass Wk of the light-weight member 16 is preferably not less than 2.5 g, but not more than 4.5 g for the same reasons.

The shore D hardness Hk of the light-weight member 16 is preferably not less than 60, more preferably not less than 67, but not more than about 95, more preferably not more than 90. If the hardness Hk is less than 60, the light-weight member 16 tends to cause a plastic deformation, therefore, there is a possibility that the position of the gravity point adjuster 14 becomes unstable.

For the elastic member 17, various materials can be used for example: thermoplastic elastomers composed of soft segment and hard segment, e.g. vulcanized rubber such as NBR and IR, silicon rubber, styrene block copolymer, polyurethane elastomer and the like; thermoplastic elastomers, e.g. nylon and the like; and polymer alloys composed of two or more kinds of polymers as far as the elastic member 17 causes an elasticity deformation between the lid 13 and the bottom end of the bottomed hole 11.

In order to provide strength and rigidity, the specific gravity pd of the elastic member 17 is preferably not less than 0.9, but not more than 1.7, the mass Wd of the elastic member 17 is preferably not less than 2.5 g, but not more than 4.5 g, and the shore A hardness Hd of the elastic member 17 is preferably not less than 35, more preferably not less than 45, but not more than 75, more preferably not more than 67.

In the example shown in FIGS. 8, 9 and 10, the heavy-weight member 15, light-weight member 16 and elastic member 17 are separated from each other.

These three members 15, 16 and 17 each have a cylindrical form having an outer diameter slightly smaller than the inner diameter of the bottomed hole 11. Accordingly, with respect to the positions of the two members 15 and 16 in the bottomed hole 11, it is possible to swap one for the other.

If the elastic member 17 is further taken into consideration, the three members 15, 16 and 17 can be arranged six ways (15-16-17, 15-17-16, 16-17-15, 16-15-17, 17-15-16, 17-16-15) in the bottomed hole 11.

FIG. 8 shows an example of the arrangement of the three members 15, 16 and 17 in the bottomed hole 11, wherein the heavy-weight member 15 is backmost. Accordingly, the depth of the center of gravity becomes maximum.

Figure 11:
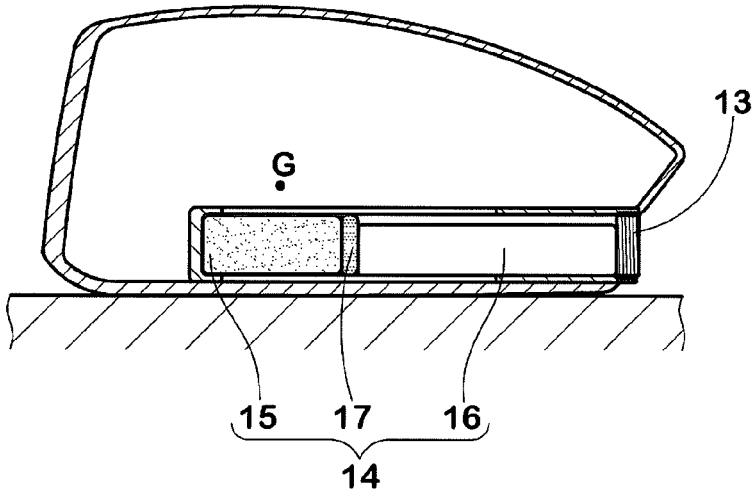
FIGS. 11 and 12 show arrangements of the separate-type gravity point adjuster.

FIG. 11 shows another example of the arrangement, wherein the heavy-weight member 15 is frontmost. Accordingly, the depth of the center of gravity becomes minimum.

Figure 12:
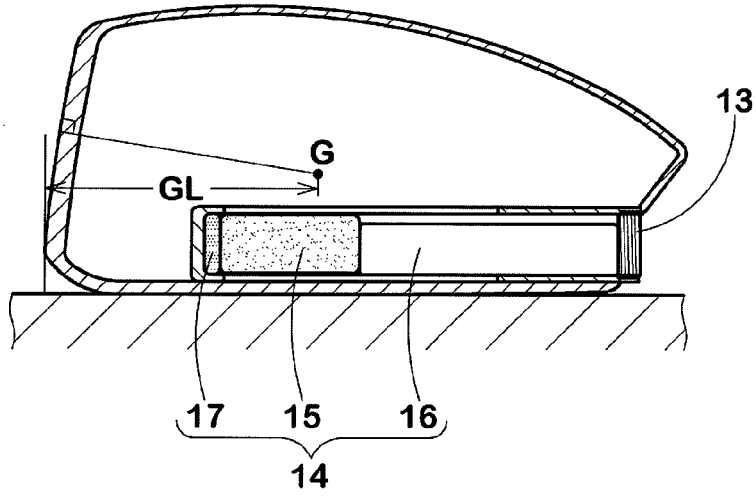

FIG. 12 shows still another example of the arrangement, wherein the heavy-weight member 15 is in between. Accordingly, the depth of the center of gravity is also in between.

Since the lid 13 can be easily attached to the insertion-opening 12 and detached therefrom by the golfer himself or herself from the outside of the club head, the golfer can change the arrangement of the three members 15, 16 and 17 according to his or her preference.

In order to increase the amount of shift of the center of gravity, the length L1 of the light-weight member 16 is set to be more than the length L2 of the heavy-weight member 15, each measured along its axis. Preferably, the ratio L1/L2 of the length L1 to the length L2 is set to be not less than 2.0, more preferably not less than 3.0, thereby it becomes possible to increase the amount of shift up to 20 mm.

If the length L2 is too long or too short, the amount of shift decreases. Therefore, the length L2 of the heavy-weight member 15 is preferably set to be not less than 7 mm, more preferably not less than 9 mm, but not more than 25 mm, more preferably not more than 23 mm.

If the length L1 is too short or too long, the amount of shift decreases. Therefore, the length L1 of the light-weight member 16 is preferably set to be not less than 30 mm, more preferably not less than 35 mm, but not more than 70 mm, more preferably not more than 65 mm.

In a free state of the gravity point adjuster 14 not inserted in the bottomed hole 11, the total (L1+L2+L3) of the length L1 of the light-weight member 16, the length L2 of the heavy-weight member 15, and the length L3 of the elastic member 17 is more than the above-mentioned effective length L so that when the gravity point adjuster 14 is inserted in the bottomed hole 11 and the lid 13 is mounted, due to the compressive deformation of the elastic member 17, the gravity point adjuster 14 is secured between the lid 13 and the end of the hole 11.

In order to effectively utilize the resilience of the elastic member 17 to secure, the length L3 is preferably not less than 3 mm, more preferably not less than 3.8 mm, but more than 7.5 mm, more preferably not more than 6.7 mm, and the ratio L3'/L3 of the length L3' of the elastic member 17 compressed to the length L3 of the elastic member 17 not compressed is preferably set to be not less than 0.40, more preferably not less than 0.43, still more preferably not less than 0.45, but not more than 0.70, more preferably not more than 0.67, still more preferably not more than 0.65.

Preferably, the length L3 of the elastic member 17 is less than the length L2 of the heavy-weight member 15.

Since the elastic member 17 is compressed in its central axis direction and the diameter or thickness expands, the cross sectional area of the elastic member 17 not compressed is set to be less than the cross sectional area of the bottomed hole 11 so that a small space S is formed therebetween as shown in FIG. 10.

If the ratio L3'/L3 is less than 0.40, which means that the rigidity of the elastic member 17 is very low, the positions of the heavy-weight member 15 and light-weight member 16 become unstable. As a result, there is a tendency that abnormal sound is generated during swing and/or at impact. If the ratio L3'/L3 is more than 0.70, the resilience of the elastic member 17 becomes insufficient, and the same problems arise.

As shown in FIGS. 13 and 14, the light-weight member 16 can be provided with a hollow in order to reduce the mass of the light-weight member 16.

In FIG. 13, the light-weight member 16 is a cylinder provided in the outer surface thereof with a plurality of hollows (four grooves 16*g*) extending in the longitudinal direction thereof, therefore, the cross section of the resultant light-weight member 16 has a crisscross shape.

In FIG. 14, the light-weight member 16 is a cylinder provided therein with a hollow (hole k) extending in the longitudinal direction, therefore, the resultant light-weight member 16 has a circular cross section.

These two examples are decreased in the mass, corresponding to the hollow(s), and thereby the weight margin usable to increase the mass of the heavy-weight member 15 increases. For that purpose, the cross sectional area Sk of the light-weight member 16 is preferably set in a range of not less than 0.45 times, more preferably not less than 0.5 times, but not more than 0.8 times, more preferably not more than 0.75 times the cross sectional area Sb of the bottomed hole 11. Thereby, the necessary rigidity is secured while decreasing the mass of the light-weight member 16.

In the case of these hollow type light-weight members 16, lightweight resin materials having appropriate rigidity such as polyethylene (PE), polyamide (nylon), polyurethane (PU), fluorocarbon resin (Teflon) and the like are preferably used.

In FIG. 15, the heavy-weight member 15 is composed of a first part 15*a* made of a material having a specific gravity, and a second part 15*b* made of a material having a specific gravity larger than that of the first part 15*a*. In other words, the heavy-weight member 15 is made of two kinds of materials having different specific gravities each larger than the light-weight member 16 and elastic member 17.

The first part 15*a* and second part 15*b* have semicircular columnar forms which are complementary to each other, therefore, by combining these into one, the cylindrical heavy-weight member 15 is formed. In this example, the division plane includes the center line of the cylindrical heavy-weight member 15. Accordingly, the center of gravity of the heavy-weight member 15 shifts from the central axis toward the second part 15*b*. Therefore, by rotating the heavy-weight member 15 around its central axis, the position of the center of gravity of the golf club head can be changed.

FIG. 16, a combination 20 of the heavy-weight member 15 and light-weight member 16 which are fixed to each other into one part. In this example, the heavy-weight member 15 has a semicircular columnar form. The light-weight member 16 comprises a first part 16*x* having a semicircular columnar form which is complementary to that of the heavy-weight member 15, and a second part 16*y* having a circular cylindrical form. Therefore, when the heavy-weight member 15 is fitted to the first part 16*x*, the combination 20 becomes a circular cylindrical form having a constant diameter throughout the length thereof.

In this example too, by rotating the combination around its central axis, the position of the center of gravity of the golf club head can be changed.

The shapes of the heavy-weight member 15 and light-weight member 16 are of course, not limited to this example. Various shapes can be employed as far as the combination 20 of the heavy-weight member 15 and light-weight member 16 is rotatable relatively to the bottomed hole 11.

If the bottomed hole 11 is a square hole for example, the combination 20 may be square because it is rotatable at 90 degree steps. If the bottomed hole 11 is a hexagonal hole, the combination 20 may be hexagonal because it is rotatable at 60 degree steps.

FIG. 17 shows another example of the combination 20 of the heavy-weight member 15 and light-weight member 16 which are fixed to each other into one part.

In this example, the two members 15 and 16 each have a circular cylindrical form having the same diameter, and the member 15 is fixed at one end of the member 16 so that the combination 20 has a circular cylindrical form having a constant diameter throughout the length thereof.

The light-weight member 16 has the length L1, and the heavy-weight member 15 has the length L2 as explained above in connection with the separated members 15 and 16.

The combination 20 has its center of gravity G1 on the heavy-weight member side of the midway point of the length L5 (=L1+L2) of the combination 20.

FIG. 18 shows still another example of the combination 20, in which the heavy-weight member 15 is completely covered with the light-weight member 16. More specifically, the light-weight member 16 has a circular cylindrical form which defines the exterior appearance of the combination 20 having a circular cylindrical form having a constant diameter throughout the length thereof. The light-weight member 16 is provided with two hollows one of which is filled with the heavy-weight member 15 and the other hollow 18 is void. The length L2 of the heavy-weight member 15 is less than the length L6 of the other hollow 18. The length L1 of the light-weight member 16 measured from the heavy-weight member 15 to the opposite end 14*b* and the length L2 are limited as explained above in connection with the separated members 15 and 16. The specific gravity of the heavy-weight member 15 is preferably not less than 14.0 but not more than 18.0. The mass of the combination 20 is not less than 9.5 g but not more than 10.5 g.

The combination 20 has its center of gravity on the heavy-weight member side of the midway point of the length L5 of the combination 20.

In the case of the above-explained combinations 20 of the heavy-weight member 15 and light-weight member 16, by inserting one end 14*a* first in the bottomed hole 11 or inserting the other end 14*b* first in the bottomed hole 11, the center of gravity of the golf club head 1 can be changed.

In the case that the golf club head 1 is provided with a plurality of the bottomed holes 11, they are identical with respect the size and shape so that the gravity point adjuster 14 can be inserted in the holes 11 whichever the golfer prefers. For the same reason, the gravity point adjusters 14 included in one golf club head are identical same with respect to the total length (L1+L2+L3) and the diameter although the gravity point adjusters 14 can be different with respect to other specifications such as mass, material, structure (solid or hollow), and individual lengths (L1, L2, L3).

The present invention is suitably applied to wood-type golf club heads, but it is also possible to apply the invention to utility golf club heads, putter golf club heads and the like.

Comparison Test 1

Based on the hollow structure shown in FIGS. 1 and 5-9, wood-type golf club heads were prepared according to the specifications shown in Table 1.

In each of the club heads, the hollow structure was composed of: a main body 1*b* made of Ti-6Al-4V (specific gravity=4.42) through a lost-wax precision casting process; and a face plate 1*a* made from a rolled sheet of Ti-6Al-4V through press molding, and the face plate was fixed to the main body by plasma welding.

The tubular part was formed integrally with main body 1*b* through the lost-wax precision casting process.

All of the heads had common specifications as follows.

Club head mass: 195 g

Club head volume: 460 cc

Loft angle: 10.5 degrees

Lie angle: 58.0 degrees

Mass of Heavy-weight member: 12.0 g

Mass of Light-weight member: 2.5 g

The heavy-weight member and the light-weight member were two separated parts.

The light-weight member was a circular cylinder made of polyethylene (specific gravity=0.94).

The heavy-weight member was a circular cylinder made of stainless steel (specific gravity=7.8).

In order that the heavy-weight members had the same mass of 12.0 g, the outer diameter was changed.

The lid was made of stainless steel and the mass was constant through all of the heads.

The center of gravity of the golf club head excluding the gravity point adjuster was constant through all of the heads.

In the test, changing the arrangements of the gravity point adjuster, the adjustable range of the depth of the center of gravity which is the difference between the maximum depth and the minimum depth, was measured.

TABLE 1

| Head | Ref. | Ex. 1 | Ex. 2 | Ex. 3 |
|---|---|---|---|---|
| Length L1 of Light-weight member (mm) | 30 | 40 | 45 | 48 |
| Length L2 of Heavy-weight member (mm) | 30 | 20 | 15 | 12 |
| Length ratio L1/L2 | 1.0 | 2.0 | 3.0 | 4.0 |
| Adjustable range (mm) | 1.5 | 2.0 | 3.1 | 3.5 |

Comparison Test 2

Based on the hollow structure shown in FIGS. 1 and 5-9, wood-type golf club heads were prepared according to the specifications shown in Table 2.

In each of the club heads, the hollow structure was composed of: a main body 1*b* made of Ti-6Al-4v (specific gravity=4.42) through a lost-wax precision casting process; and a face plate 1*a* made from a rolled sheet of Ti-6Al-4V through press molding, and the face plate was fixed to the main body by plasma welding.

The tubular part was formed integrally with the main body 1*b* through the lost-wax precision casting process excepting Ex. 13.

In Ex. 13, the tubular part was made of 15-3-3-3Ti, namely, formed separately from the main body 1*b* and plasma-welded to the main body.

The heavy-weight member and the lid (made of Ti-6Al-4V) were formed by NC machining.

The elastic member was formed by injection molding.

The specifications of the materials used to make the heavy-weight member and elastic member are as follows.

| Material | code used in Table 2 | shore A or D hardness | specific gravity |
|---|---|---|---|
| silicon rubber | SI | A 65 | 1.16 |
| polyethylene | PE | D 80 | 0.94 |
| polyurethane | PU | D 75 | 1.2 |
| stainless steel | SS | | 7.8 |
| W—Ni | WNi | | 16 |

The shore A hardness and shore D hardness were measured according to ASTM-D2240.

In the test, the adjustable range as explained above was measured. Further, the head was checked if abnormal sound was generated at impact by the members of the gravity point adjuster due to their movements or collision within the bottomed hole.

In this abnormal sound test, the club head was attached to a club shaft "SV-3005, flex X" manufactured by SRI Sports Ltd. to form a wood club. The wood club was mounted on a swing robot, and hit golf balls 1000 times at the sweet spot with a head speed of 54 m/s. The test results are shown in Table 2.

TABLE 2

| Head | Ref. 1 | Ref. 2 | Ex. 1 | Ex. 2 | Ex. 3 | Ex. 4 | Ex. 5 | Ex. 6 |
|---|---|---|---|---|---|---|---|---|
| Structure (FIG. no) | 1 | 1 | 1 | 1 | 1 | 1 | 1 | 1 |
| Head mass (gram) | 198.0 | 197.5 | 194.0 | 198.8 | 194.0 | 195.5 | 195.2 | 194.8 |
| Bottomed hole length L | 60 | 60 | 60 | 60 | 60 | 60 | 60 | 60 |
| Through hole length Lo | 0 | 0 | 30 | 0 | 30 | 30 | 30 | 30 |
| Lo/L | 0.00 | 0.00 | 0.50 | 0.00 | 0.50 | 0.50 | 0.50 | 0.50 |
| Light-weight member | | | | | | | | |
| material | PE | PE | PE | PE | PE | PE | PE | PE |
| (mass gram) | (3.5) | (2.9) | (4.0) | (2.6) | (4.0) | (3.9) | (3.8) | (3.7) |
| length: L1 (mm) | 18 | 27 | 48 | 30.2 | 47.3 | 46.5 | 45.8 | 45.2 |
| section area ratio Sk/Sb | 1.00 | 1.00 | 0.60 | 1.00 | 0.60 | 0.60 | 0.60 | 0.60 |
| Heavy-weight member | | | | | | | | |
| material | SS | SS | SS | SS | SS | SS | SS | SS |
| (mass gram) | (11.0) | (16.5) | (6.5) | (18.3) | (6.5) | (7.2) | (7.1) | (7.0) |
| length: L2 (mm) | 36 | 30.2 | 10.5 | 27 | 10.5 | 11.6 | 11.4 | 11.3 |
| Elastic member | | | | | | | | |
| material | SI | SI | SI | SI | SI | SI | SI | SI |
| (mass gram) | (0.5) | (0.5) | (0.5) | (0.5) | (0.5) | (0.5) | (0.5) | (0.5) |
| free length: L3 | 5 | 5 | 5 | 5 | 5 | 5 | 5 | 5 |
| compressed length: L3' | 5 | 2.8 | 1.5 | 2.8 | 2.2 | 2 | 2.8 | 3.5 |
| L3'/L3 | 1.00 | 0.56 | 0.30 | 0.56 | 0.44 | 0.40 | 0.56 | 0.70 |
| L1/L2 | 0.5 | 0.9 | 4.6 | 1.1 | 4.5 | 4.0 | 4.0 | 4.0 |
| L1 + L2 + L3 (mm) | 59 | 62.2 | 63.5 | 62.2 | 62.8 | 63.1 | 62.2 | 61.5 |
| Test results | | | | | | | | |
| Adjustable range (mm) | 1.1 | 1.2 | 2.2 | 1.8 | 2.2 | 2.4 | 2.3 | 2.5 |
| Abnormal sound generated? | yes | no | yes | no | no | no | no | no |

| Head | Ex. 7 | Ex. 8 | Ex. 9 | Ex. 10 | Ex. 11 | Ex. 12 | Ex. 13 |
|---|---|---|---|---|---|---|---|
| Structure (FIG. no) | 1 | 1 | 1 | 1 | 1 | 2 | 1 |
| Head mass (gram) | 194.0 | 195.6 | 195.3 | 194.5 | 195.8 | 199.7 | 194.1 |
| Bottomed hole length L | 60 | 65 | 90 | 60 | 61.3 | 60 | 73.4 |
| Through hole length Lo | 30 | 43 | 58 | 45 | 0 | 45 | 45 |
| Lo/L | 0.50 | 0.66 | 0.64 | 0.75 | 0.00 | 0.75 | 0.61 |
| Light-weight member | | | | | | | |
| material | PE | PE | PE | PE | SI | PU | PU |
| (mass gram) | (3.8) | (3.5) | (3.9) | (3.8) | (3.9) | (2.5) | (3.7) |
| length: L1 (mm) | 31.4 | 40.5 | 64.1 | 45.8 | 46.9 | 46.9 | 58.0 |
| section area ratio Sk/Sb | 0.60 | 0.45 | 0.50 | 0.60 | 0.65 | 0.48 | 0.57 |
| Heavy-weight member | | | | | | | |
| material | SS | WNi | WNi | SS | SS | SS | WNi |
| (mass gram) | (6.2) | (15.8) | (17.3) | (6.2) | (6.4) | (6.4) | (16.0) |
| length: L2 (mm) | 24.6 | 20.6 | 21.6 | 10 | 11.6 | 10.3 | 11.3 |
| Elastic member | | | | | | | |
| material | SI | SI | SI | SI | SI | SI | SI |
| (mass gram) | (0.5) | (0.6) | (0.6) | (0.5) | (0.5) | (0.5) | (0.6) |
| free length: L3 | 5 | 6.1 | 6.5 | 5 | 5 | 5 | 6.5 |
| compressed length: L3' | 4 | 3.9 | 4.3 | 4.2 | 2.8 | 2.8 | 4.1 |
| L3'/L3 | 0.80 | 0.64 | 0.66 | 0.84 | 0.56 | 0.56 | 0.63 |
| L1/L2 | 1.3 | 2.0 | 3.0 | 4.6 | 4.0 | 4.5 | 5.1 |
| L1 + L2 + L3 (mm) | 61 | 67.2 | 92.2 | 60.8 | 63.5 | 62.2 | 75.8 |
| Test results | | | | | | | |
| Adjustable range (mm) | 2.1 | 3.4 | 3.7 | 2.3 | 1.8 | 3.8 | 4.3 |
| Abnormal sound generated? | yes | no | no | yes | no | no | no |

The invention claimed is:

1. A combination of a golf club head and a gravity point adjuster, wherein the golf club head comprises a hollow structure having an insertion-opening in the outer surface of the golf club head, a quick-release lid of the insertion-opening, and a tubular part disposed in a hollow of the hollow structure and having a bottomed hole with which the insertion-opening communicates, and the gravity point adjuster comprises a heavy-weight member having a specific gravity and a length L2, a light-weight member having a specific gravity less than that of the heavy-weight member and a length L1 more than the length L2, and an elastic member having a specific gravity less than that of the heavy-weight member, and an elastic modulus lower than those of the heavy-weight member and light-weight member, wherein the heavy-weight member, the light-weight member and the elastic member are inserted in the bottomed hole by the use of the insertion-opening so that their relative positions relative to the bottomed hole can be changed and wherein a wall of the tubular part partitioning between the bottomed hole and the hollow is provided with one or more through-holes, and a wall of the tubular part partitioning between the bottomed hole and the hollow is provided with one or more through-holes.

2. The combination according to claim 1, wherein the bottomed hole extends in a front-back direction of the golf club head.

3. The combination according to claim 1, wherein the bottomed hole extends in a toe-heel direction of the golf club head.

4. The combination according to claim 1, wherein the bottomed hole extends in a vertical direction of the golf club head.

5. The combination according to claim 1, wherein the golf club head is provided with plural sets of the tubular part having the bottomed hole, the insertion-opening communicating with the bottomed hole, and the quick-release lid of the insertion-opening.

6. The combination according to claim 1, wherein the golf club head is provided with plural sets of the tubular part having the bottomed hole, the insertion-opening communicating with the bottomed hole, and the quick-release lid of the insertion-opening, and the gravity point adjuster is disposed in each of the bottomed holes.

7. The combination according to claim 1, wherein the heavy-weight member and the light-weight member are separated parts.

8. The combination according to claim 7, wherein the light-weight member is provided with a closed hollow or an open hollow.

9. The combination according to claim 7, wherein the light-weight member is provided with a hollow extending along its length, and the cross sectional area Sk of the light-weight member is not less than 0.45 times and not more than 0.8 times the cross sectional area Sb of the bottomed hole.

10. The combination according to claim 7, wherein the length L1 of the light-weight member is not less than 2.0 times the length L2 of the heavy-weight member.

11. The combination according to claim 7, wherein the heavy-weight member is composed of a first part and a second part made of two kinds of materials having different specific gravities each larger than the light-weight member and the elastic member, the first part and second part having semicircular columnar forms which are complementary to each other so that, by combining these into one, the cylindrical heavy-weight member is formed, and the division plane between the first part and second part includes the center axis of the cylindrical heavy-weight member, whereby the center of gravity of the heavy-weight member shifts radially from its center axis.

12. The combination according to claim 1, wherein the heavy-weight member and the light-weight member are combined into one part in the form of a stick so that the center of gravity of the combined heavy-weight member and light-weight member shifts towards the heavy-weight member side from the middle point of the length of the combined heavy-weight member and light-weight member.

13. The combination according to claim 12, wherein the heavy-weight member is fixed to one end of the light-weight member.

14. The combination according to claim 12, wherein the heavy-weight member is fixed to one end of the light-weight member, and the length L1 of the light-weight member is not less than 2.0 times the length L2 of the heavy-weight member.

15. The combination according to claim 12, wherein the heavy-weight member is embedded in the light-weight member.

16. The combination according to claim 12, wherein the light-weight member is provided with a closed hollow or an open hollow.

17. The combination according to claim 1, wherein the elastic member has a shore A hardness of from 35 to 75.

18. The combination according to claim 17, wherein in the bottomed hole, the elastic member is compressed in the direction of the central axis of the bottomed hole, and the length of the elastic member in the compressed state is in a range of from 0.4 to 0.7 times the length of the elastic member in its free state.

19. The combination according to claim 17, wherein the elastic member in its free state has a size such that a small gap is formed between the inner surface of the bottomed hole and the outer surface of the elastic member in its free state inserted in the bottomed hole.

20. The combination according to claim 1, wherein the tubular part and the hollow structure are formed by integral molding.

21. The combination according to claim 1, wherein the tubular part is formed from a lightweight metal material and welded to the hollow structure.

22. The combination according to claim 1, wherein the tubular part is formed from a lightweight material and fixed to the hollow structure by means of adhesive or press fitting.

* * * * *